US007861365B2

(12) United States Patent
Sun et al.

(10) Patent No.: US 7,861,365 B2
(45) Date of Patent: Jan. 4, 2011

(54) ROBOTIC VACUUM CLEANER

(75) Inventors: Yann-Shuoh Sun, Taipei County (TW); Jiing-Fu Chen, Hsinchu (TW); Yu-Liang Chung, Taipei (TW); Weng-Jung Lu, Hsinchu (TW); Meng-Chun Chen, Tainan County (TW); Chun-Hsien Liu, Taipei (TW)

(73) Assignee: Industrial Technology Research Institute, Hsin-Chu (TW)

( * ) Notice: Subject to any disclaimer, the term of this patent is extended or adjusted under 35 U.S.C. 154(b) by 1130 days.

(21) Appl. No.: 11/537,656

(22) Filed: Oct. 1, 2006

(65) Prior Publication Data

US 2008/0066257 A1 Mar. 20, 2008

(30) Foreign Application Priority Data

Sep. 19, 2006 (TW) ..... 95134528 A

(51) Int. Cl.
*A47L 9/28* (2006.01)

(52) U.S. Cl. ..... 15/319; 15/340.3; 15/347

(58) Field of Classification Search ..... 15/319, 15/339, 340.1, 340.3, 347; *A47L 9/28*
See application file for complete search history.

(56) References Cited

U.S. PATENT DOCUMENTS

2005/0132680 A1 6/2005 Wegelin

2008/0282494 A1* 11/2008 Won et al. ..... 15/319

FOREIGN PATENT DOCUMENTS

| | | | |
|---|---|---|---|
| GB | 2344778 | A | 6/2000 |
| GB | 2400087 | A | 10/2004 |
| GB | 2405083 | A | 2/2005 |
| JP | 2004-337301 | A | 12/2004 |
| TW | I220383 | | 4/2004 |
| TW | I220383 | | 8/2004 |
| TW | M246471 | | 10/2004 |
| TW | M247170 | | 10/2004 |

* cited by examiner

*Primary Examiner*—David A Redding
(74) *Attorney, Agent, or Firm*—WPAT, PC; Justin King

(57) ABSTRACT

A robotic vacuum cleaner is disclosed in the present invention, which comprises a controller, at least a driving wheel module, and a dust-collecting module. The controller is disposed on a housing plate. The driving wheel module, electrically connecting to the controller, further includes: a driver; a wheel connecting to the output shaft of the driver; a linkage rod, having two ends pivotally fixed on the housing plate and the driver respectively; and a resilience element, having two ends pivotally connected to the housing plate and the driver respectively. The dust-collecting module, disposed on the housing plate, is capable of vacuuming for filtering and collecting dust.

19 Claims, 14 Drawing Sheets

ROBOTIC VACUUM CLEANER

FIELD OF THE INVENTION

The present invention relates to a cleaning apparatus, and more particularly, to a robotic vacuum cleaner capable of vacuuming dust while maneuvering around obstacles in an autonomous manner.

BACKGROUND OF THE INVENTION

An autonomous vacuum cleaner, being a fully automated cleaning device, is a renovating device different from those conventionally vacuum cleaners and other sweeping devices, that is can clean a specific area autonomously without any human attention and thus is foreseen to be the future cleaning device replacing those conventional manual-operated vacuum cleaners and other cleaning devices. After the operation mode is set, an autonomous vacuum cleaner is able to maneuver around obstacles while performing a ground cleaning operation, even cleaning those usually considered as the dead spots of cleaning.

Although the autonomous vacuum cleaner is a great help to daily household cleaning, its function is limited by its power source, which is not an alternating current (AC) power source, and by its own interior space, which limited the same from adopting those air compressors used in those conventional vacuum cleaners. Therefore, as the autonomous vacuum cleaner only has limited power supply, a good centrifugal fan is essential for enabling the same to have good performance. Nonetheless, the centrifugal fan is beneficial for its operating noise is lower than those conventional air compressors.

It is noted that there are already several prior-art techniques of robotic vacuuming cleaner currently available on the market. One such technique is disclosed in TW Pat. No. I220383, which shows a conventional contact-type autonomous vacuuming cleaner. However, the aforesaid contact-type autonomous vacuuming cleaner is short in that: the drivers and the wheels used in the driving wheel module of the contact-type autonomous vacuuming cleaner is not detachable from the driver such that it is required to replace the whole driving wheel module when there is only required to repair a broken motor of a driver or to replace the tire of a wheel, which is costly. In addition, the aforesaid contact-type autonomous vacuuming cleaner is not adapted for cleaning dead spots so that it is not efficient when it comes to dead spot cleaning. Moreover, as the aforesaid cleaner can be attached with a mopping unit for using the same to perform a floor-mopping operation, it is important to remind a user to replace/clean the mopping unit constantly and periodically, otherwise, mopping floor with a dirty mopping unit is not a good idea for cleaning.

In those prior-art techniques of robotic vacuuming cleaner, it is common to fit the cleaner with side brooms for enabling the same the ability to clean dust accumulated at corners. However, those side brooms often are the major noise producer of the cleaner.

Therefore, it is in need of an improved robotic vacuum cleaner that is freed from the foregoing drawbacks.

SUMMARY OF THE INVENTION

The primary object of the present invention is to provide a robotic vacuum cleaner capable of using a suspension means of its driving wheel module to lift the bottom thereof from the ground by a specific height, and thereby, enable the wheels thereof to cross over obstacles.

It is another object of the invention to provide a robotic vacuum cleaner having driving wheel module with detachable motor and wheels, by which the maintenance process thereof can be simplified.

Yet, another object of the invention to provide a robotic vacuum cleaner with obstacle maneuvering-around and missing-step prevention capabilities, by which the robotic vacuum cleaner can function efficiently and safely.

Further, another object of the invention to provide a low noise, high flow rate robotic vacuum cleaner with asymmetry fan housing design and uniform airflow channel.

Furthermore, another object of the invention to provide a robotic vacuum cleaner capable of utilizing its specially designed dust-collecting case to assemble a centrifugal fan apparatus therein for enabling the robotic vacuum cleaner to perform a dust-collecting operation while maintaining the smoothness of airflow in the centrifugal fan apparatus.

Moreover, one further object of the invention is to provide a robotic vacuum cleaner capable using a noise-reduced side-wind generation unit for blowing away and thus cleaning the dust accumulated around corners.

To achieve the above objects, the present invention provides a robotic vacuum cleaner: comprising: a controller, disposed on a housing plate; at least a driving wheel module, each being disposed on the housing plate while electrically connecting to the controller; and a dust-collecting module, disposed on the housing plate for vacuuming for filtering and collecting dust; wherein each driving wheel module further comprises: a driver; a wheel, connecting to the output shaft of the driver; a linkage rod, having two ends pivotally fixed on the housing plate and the driver respectively; and a resilience element, having two ends pivotally connected to the housing plate and the driver respectively.

Preferably, the dust-collecting module further comprises: a dust-collecting case, having a vacuum inlet positioned under the housing plate; and a centrifugal fan unit, connected to the dust-collecting case by an intake end thereof for receiving air flow sucked from the vacuum inlet. In addition, the centrifugal fan unit is comprised of: a housing with an accommodating space, having an intake hole and an outflow hole; an impeller, arranging in the accommodating space while enabling an airflow channel of uniform width to be formed between a rim of the impeller and a side wall of the housing, and enabling the accommodating space to be divided into a first space and a second space by a virtual cross section passing the axial center of the impeller, referring as axial cross section hereinafter, for enabling the first space to be asymmetrical to the second space; and a driving device, connected to the impeller for driving the same to rotate; wherein a helical airflow channel is extending from the second space and channeling to the outflow hole in a manner that the sectional area of the helical airflow channel is increasing progressively from the beginning thereof to the outflow hole. Moreover, the dust-collecting case is comprised of: a case, having a recess and a through hole channeling to the recess, and a side thereof being arranged with a groove hole channeling to the recess; a dust-collecting lid, having the vacuum inlet arranged thereon while being connected to the groove hole; a box with a dust-collecting space, capable of being received in the recess for enabling the duct-collecting space to channel with the through hole and the groove hole.

Preferably, an edge of the housing plate is designed with a rake angle.

Preferably, a collision sensor, electrically connected to the controller, is arranged at a front end of the housing plate, which can be substantially a pressure sensor. Moreover, the collision sensor is comprised of: a base; a resilience element, ensheathing the base; a pillar, having an end abutted against the resilience element; a first contact plate, connected to an end of the pillar not abutted against the resilience element; and a second contact plate, being arranged at a position corresponding to the first contact plate.

Preferably, at least an obstacle detection unit is arranged at the bottom of the housing plate while enabling each to be electrically connected to the controller. Moreover, each obstacle detection unit is comprised of: a base; a resilience element, ensheathing the base; a pillar, having an end abutted against the resilience element; a first contact plate, connected to an end of the pillar not abutted against the resilience element; and a second contact plate, being arranged at a position corresponding to the first contact plate.

Preferably, a side-wind generation unit is arranged at a side of the housing plate, whereas the side-wind generation unit can be a centrifugal fan or an axial fan.

Other aspects and advantages of the present invention will become apparent from the following detailed description, taken in conjunction with the accompanying drawings, illustrating by way of example the principles of the present invention.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

Figure 1:
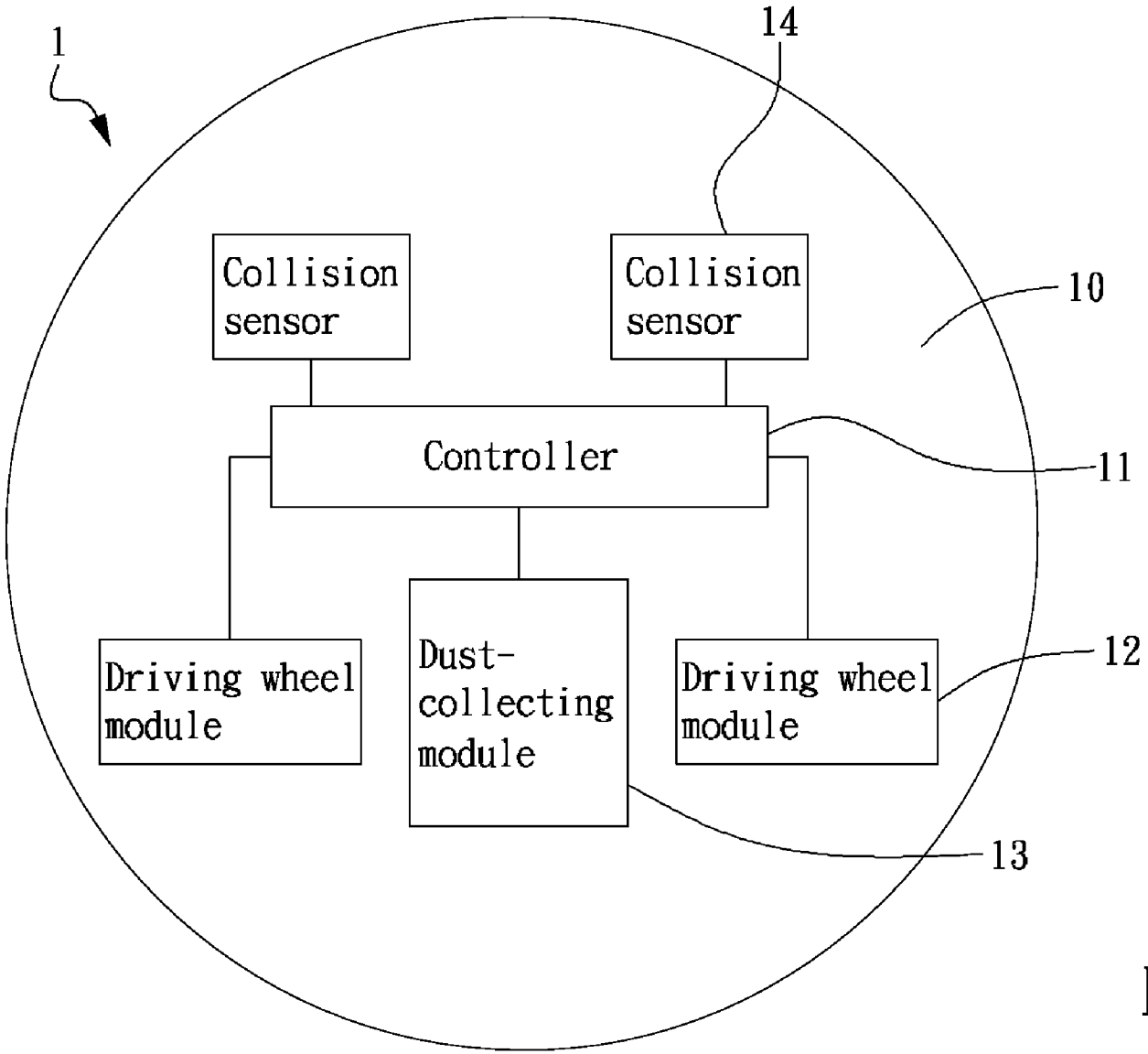
FIG. 1 is a schematic diagram showing a robotic vacuum cleaner according to a preferred embodiment of the invention.

Please refer to FIG. 1, which is a schematic diagram showing a robotic vacuum cleaner according to a preferred embodiment of the invention. In FIG. 1, the robotic vacuum cleaner 1 is comprised of a controller 11, a pair of driving wheel modules 12, a dust-collecting module 13 and a pair of collision sensors 14. Each driving wheel module 12, being disposed on a housing plate 10 and electrically connected to the controller 11, is used for providing moving power to the robotic vacuum cleaner. It is noted that the driving wheel module is directed to act with respect to the signal transmitted from the controller 11, and thus the robotic vacuum cleaner is driven thereby to move while performing a vacuuming operation.

Figure 2A:
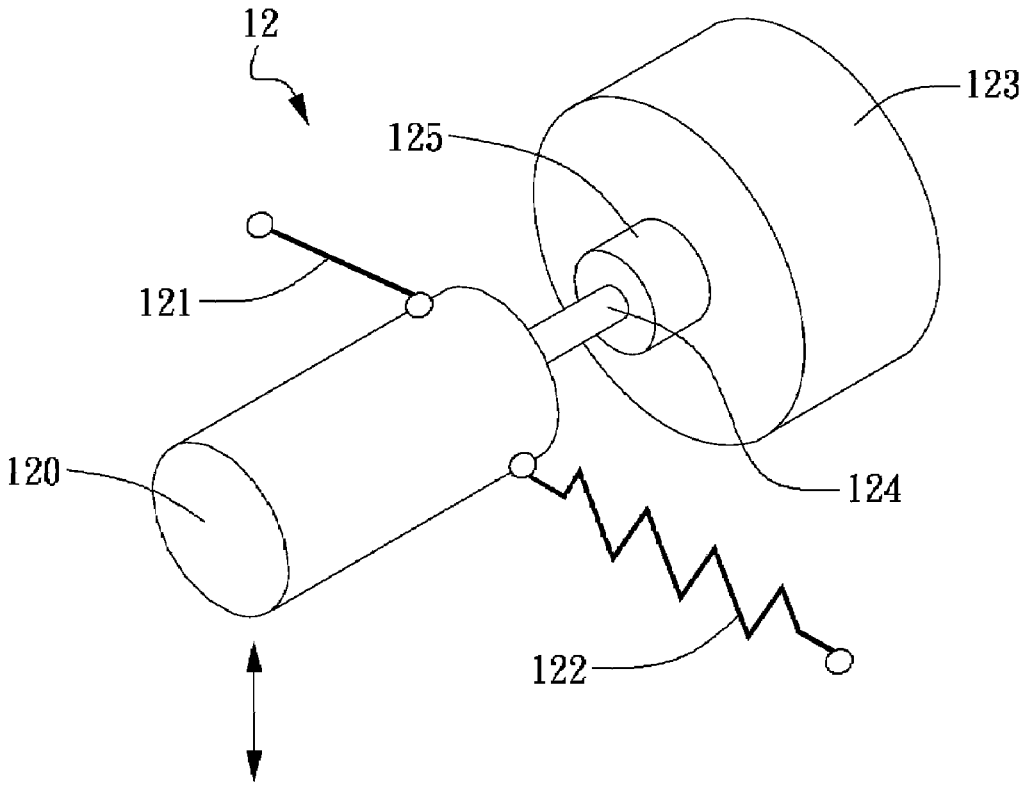
FIG. 2A to FIG. 2C are schematic views of a driving wheel module according to a preferred embodiment of the invention.
Figure 2B:
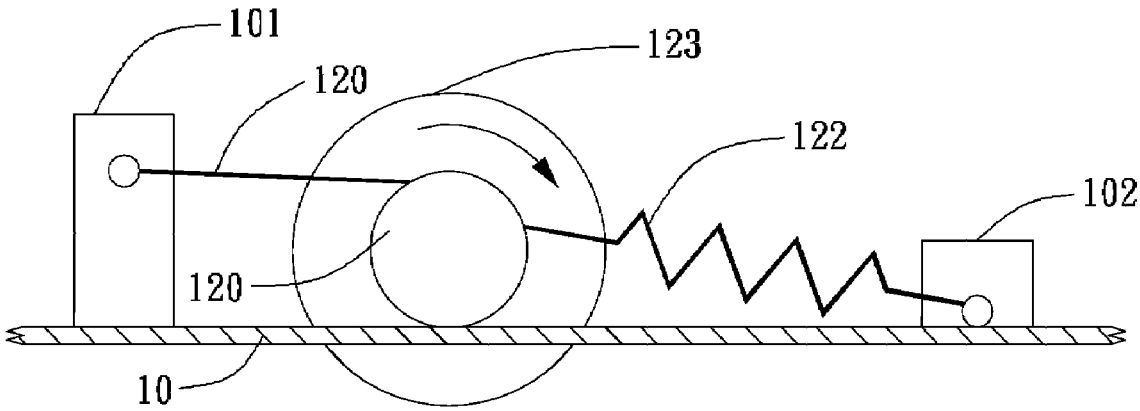

Please refer to FIG. 2A and FIG. 2B, which are schematic views of a driving wheel module according to a preferred embodiment of the invention. As seen in FIG. 2A, each driving wheel module is further comprised of a driver 120, a wheel 123, a linkage rod 121 and a resilience element 122. The wheel 123 is connected to an output shaft 124 of the driver 120 by an interfacing part 125, by which power of the driver 120 can be transmitted to the wheel 123 for enabling the same to rotate. In addition, by the disposition of the interfacing part 125, the wheel 123 can be detached from the driver 120, i.e. the wheel 123 is detachable, and thus the maintenance thereof can be facilitated. The linkage rod 121 is connected to the driver 120 by an end thereof while another end thereof is connected to a seat 101 of the housing plate 10. Moreover, the resilience element 122 is connected to the driver 120 by an end thereof while another end thereof is connected to another seat 102 of the housing plate 10. In a preferred aspect, the driver can be an assembly of a motor and a gear reducer.

Figure 2C:
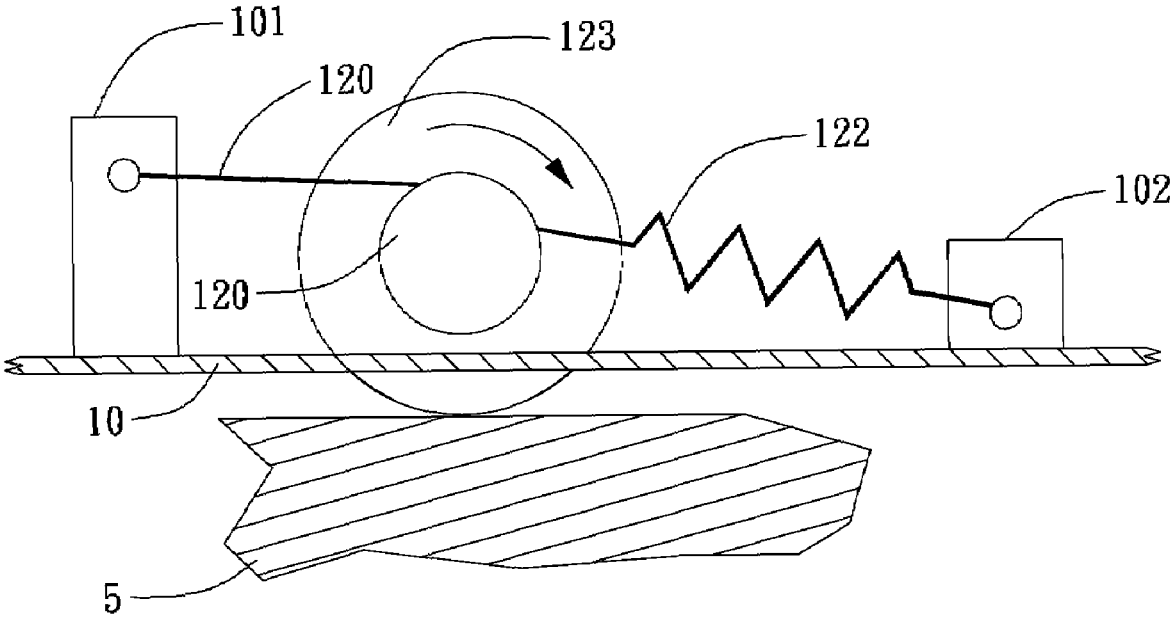
Figure 2D:
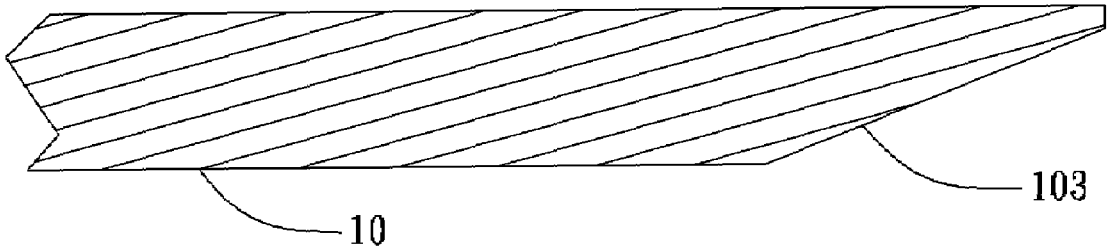
FIG. 2D is a schematic diagram showing a rake angle of a housing plate adopted in a robotic vacuum cleaner of the present invention.

As the wheel is hanging without contacting to ground, the driver 120 will have contacted with the housing plate 10 according to the weight disposition of the robotic vacuum cleaner 1, as seen in FIG. 2B. Nevertheless, as seen in FIG. 2C that the wheel 123 is contacting to ground 5, the driver 120 is separated from the housing plate 10 by a distance that the distance can be considered as the height limit that the robotic vacuum cleaner 1 capable of crossing-over. In a circumstance that the robotic vacuum cleaner 1 is crossing over an obstacle on the ground, the housing plate will be lift and thus the distance between the driver 120 and the housing plate 10 is narrowed, as seen in FIG. 2D. Therefore, it is preferred to design an edge of the housing plate 10 with a rake angle 10 so as to facilitate the crossing-over.

Figure 3:
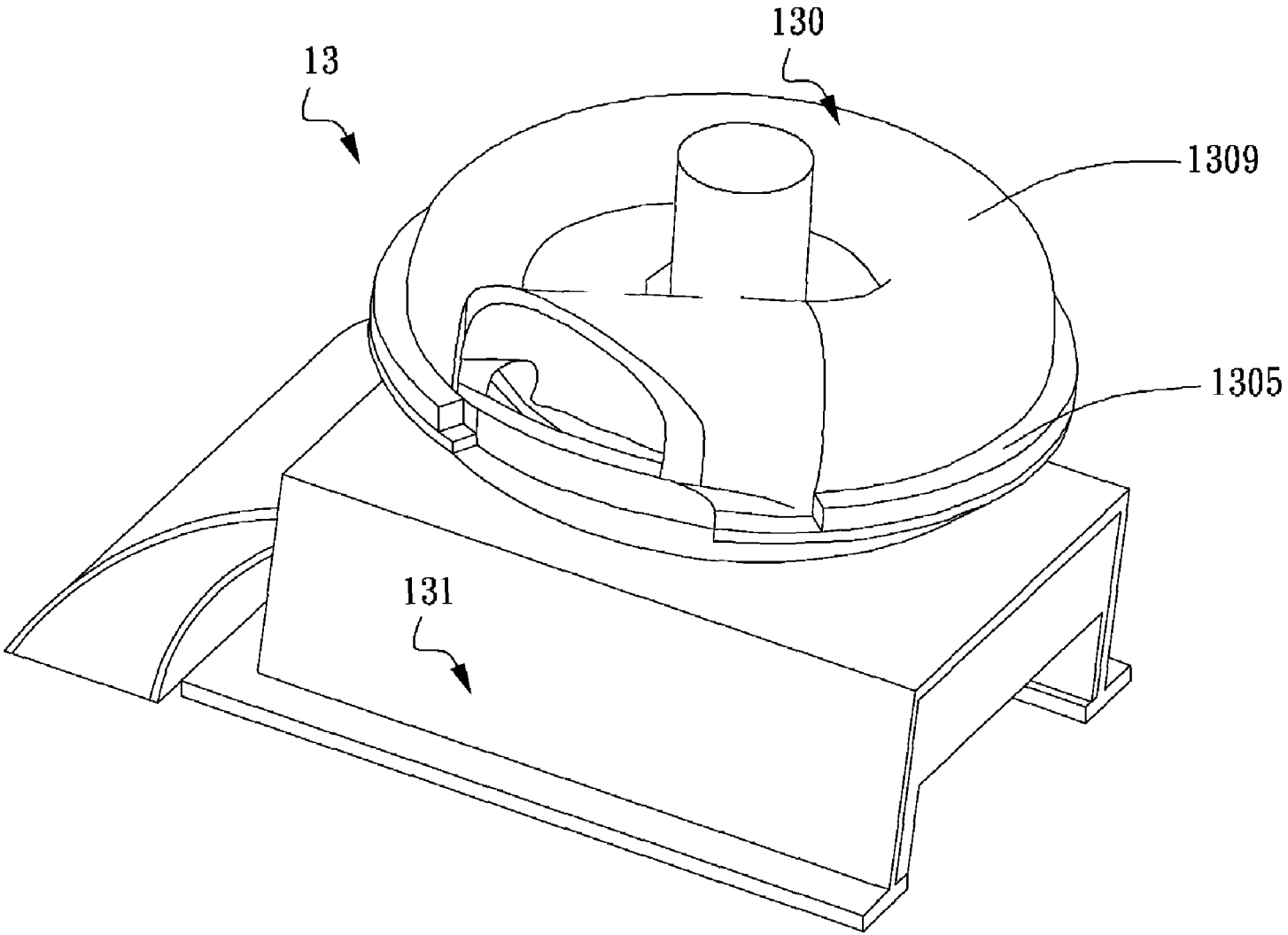
FIG. 3 is a schematic diagram showing a dust-collecting module used in a robotic vacuum cleaner of the present invention.
Figure 4:
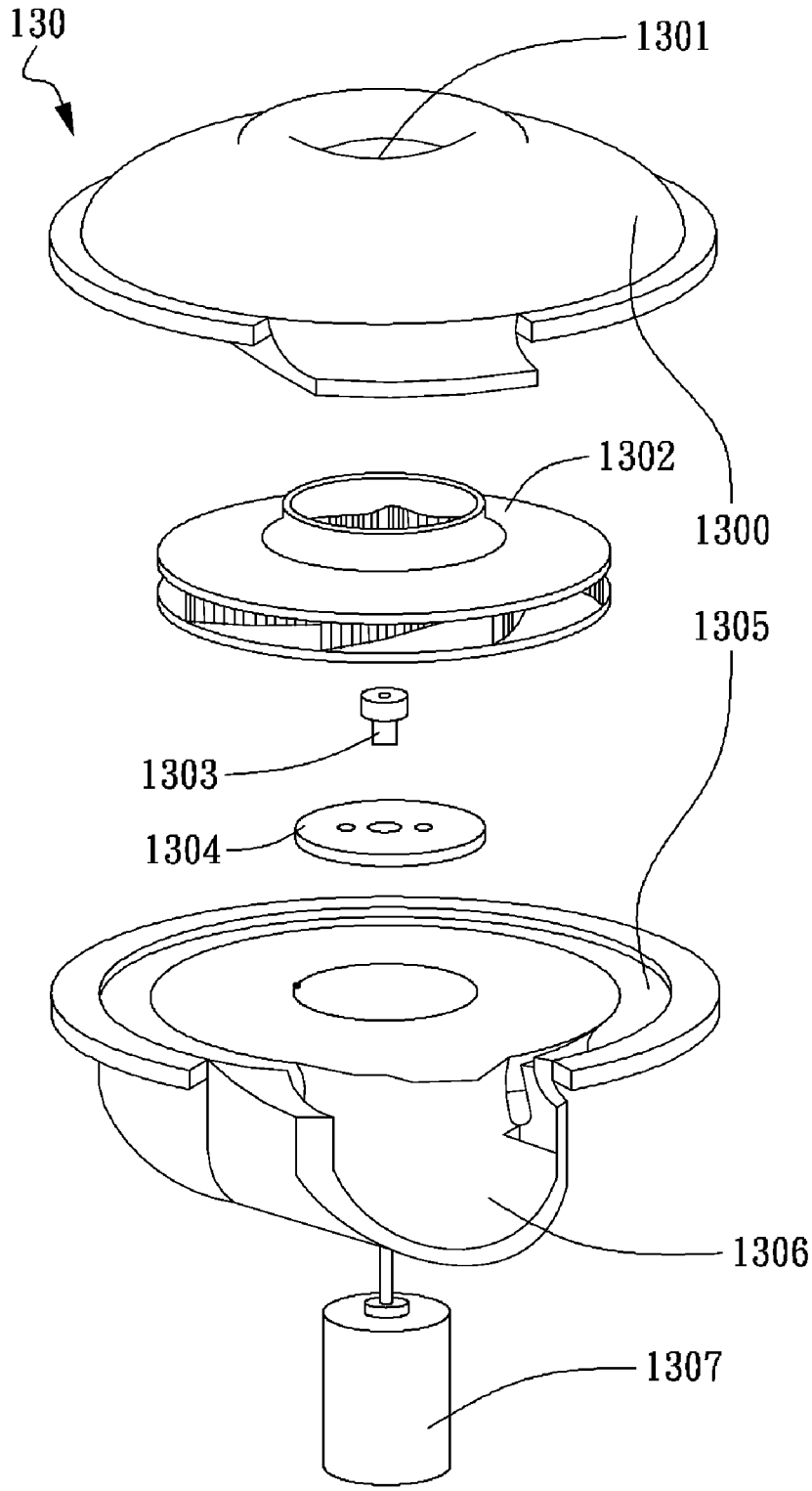
FIG. 4 is an exploded diagram illustrating a centrifugal fan unit used in a robotic vacuum cleaner of the present invention.

Please refer to FIG. 3, which is a schematic diagram showing a dust-collecting module used in a robotic vacuum cleaner of the present invention. The dust-collecting module 13 is comprised of a centrifugal fan unit 130 and a dust-collecting case 131. Please refer to FIG. 4, which is an exploded diagram illustrating a centrifugal fan unit used in a robotic vacuum cleaner of the present invention. The centrifugal fan unit 130 is further composed of a housing, an impeller 1302 and a driving device 1307. The housing, which is composed of a top shell 1300 and a bottom shell 1305, is different from those conventional centrifugal fan with spiral-shaped housing in that: the axial cross section of an accommodating space formed by the assembling of the top shell 1300 and the bottom shell 1305 is shaped as a disc, which is different from those of prior arts. In addition, an intake hole 1301 is formed at the center of the top shell 1300, and an outflow hole 1306 is formed at a side of the bottom shell 1305. The driving device 1307 is connected to the impeller 1302 by a pin 1303 and an interfacing panel 1304 so that the impeller 1302 can be driven to rotate by the driving device 1307.

Figure 5A:
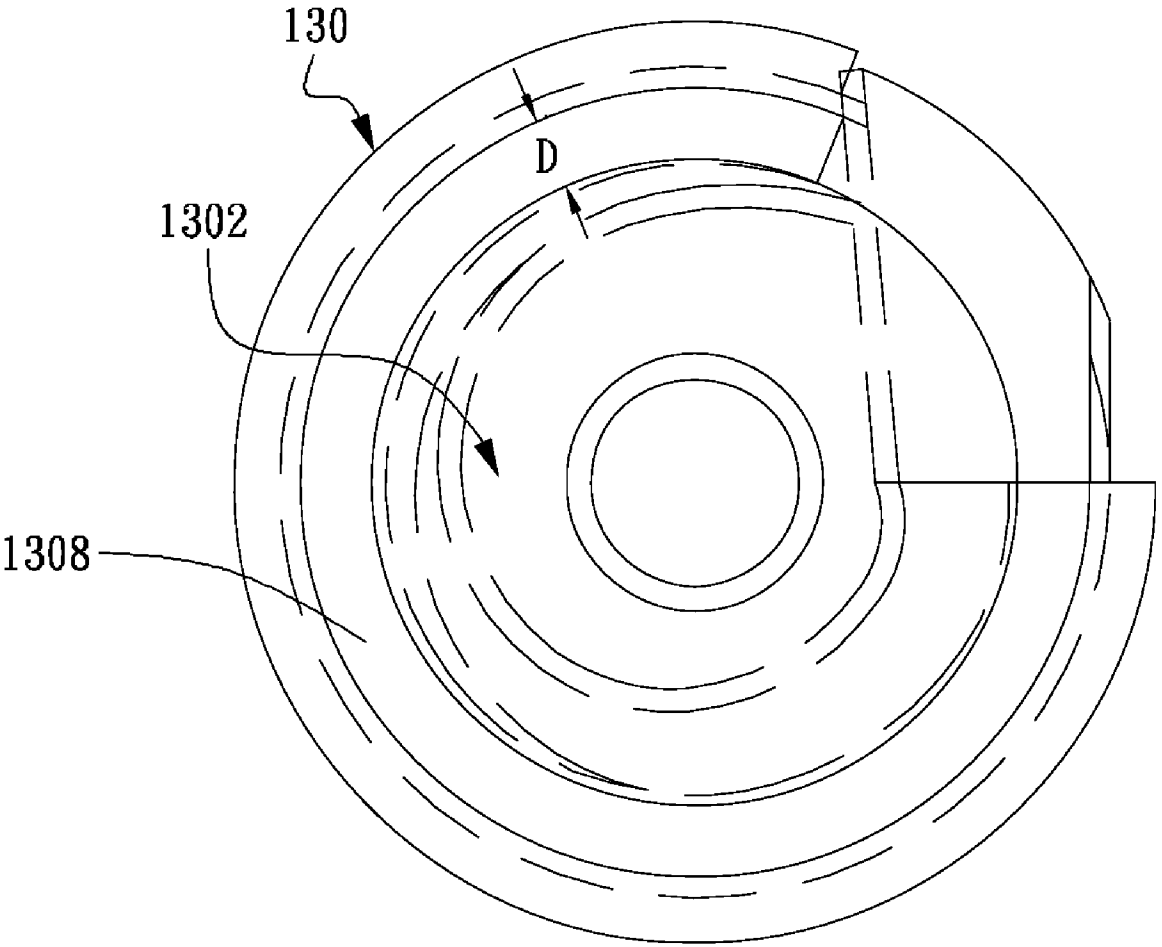
FIG. 5A is a top view of a centrifugal fan unit used in a robotic vacuum cleaner of the present invention.
Figure 5B:
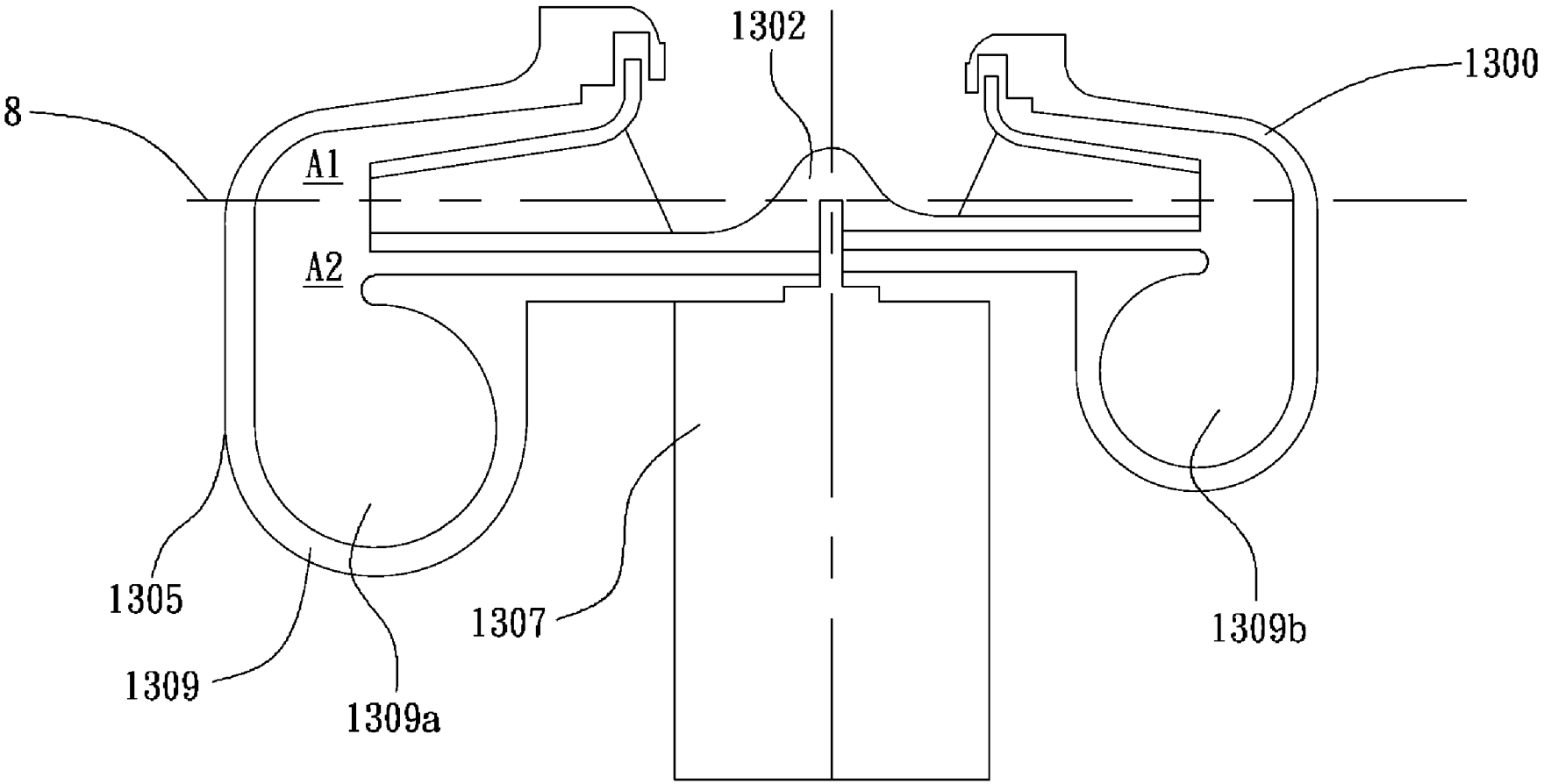
FIG. 5B is an axial sectional view of a centrifugal fan unit used in a robotic vacuum cleaner of the present invention.

Please refer to FIG. 5A, which is a top view of a centrifugal fan unit according to the present invention. In FIG. 5A, the manner that the impeller 1302 is being arranged inside the housing is illustrated. As the axial cross section of the accommodating space of the housing is shaped like a disc, an airflow channel 1308 of uniform width D can be formed between a rim of the impeller 1302 and a side wall of the housing. Please refer to FIG. 5B, which is a cross sectional view of a centrifugal fan unit according to the present invention. In FIG. 5B, the accommodating space is being divided into a first space A1 and a second space A2 by a virtual cross section 8 passing the axial center of the impeller 1302 while enabling the first space A1 to be asymmetrical to the second space A2. As seen in FIG. 3B and FIG. 5B, a helical airflow channel 1309 is formed in the second space A2 by the bottom shell 1305 whereas the sectional area of the helical airflow channel 1309 is increasing progressively from the beginning thereof to the outflow hole. In FIG. 5B, two sections 1309*a*, 1309*b* are shown whereas the section 1309*a* is at a position near the outflow hole and the section 1309*b* is at a position near the beginning thereof, in which the area of the section 1309*a* is larger than that of the section 1309*b*.

Figure 6B:
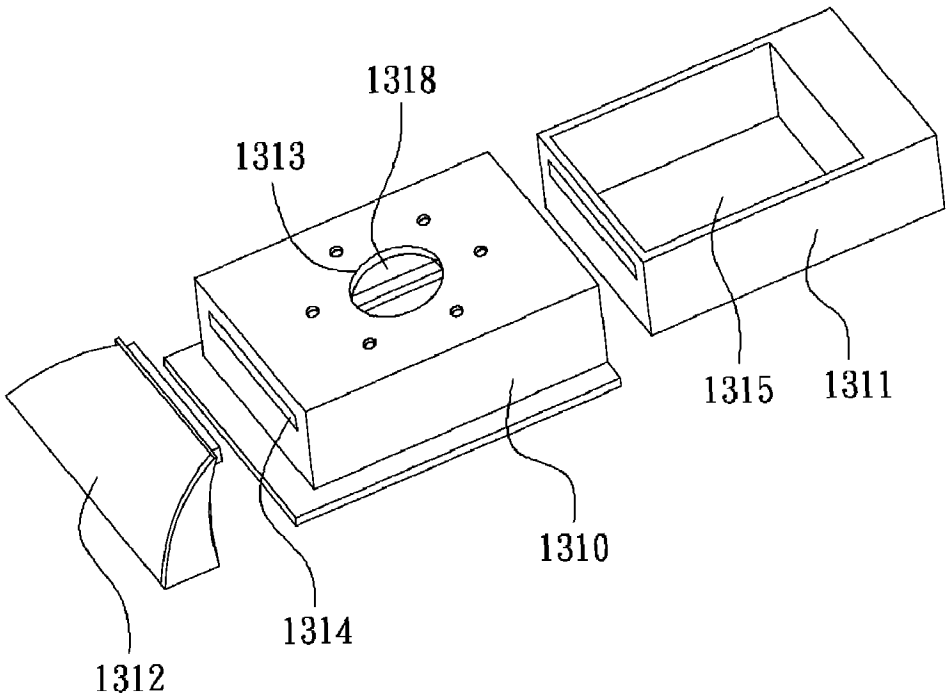
FIG. 6B is an exploded diagram illustrating a dust-collecting case of the invention.
Figure 6A:
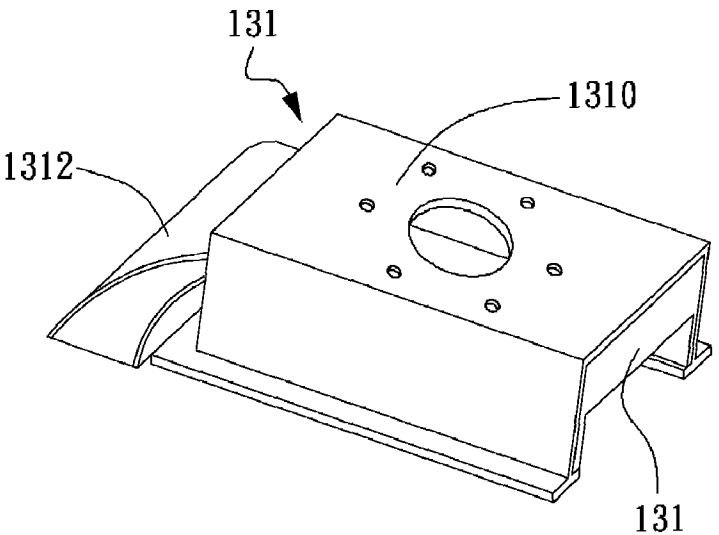
FIG. 6A is a pictorial view of a dust-collecting case of the invention.

Please refer to FIG. 6A and FIG. 6B, which are respectively a schematic diagram and an exploded diagram showing a dust-collect case according to a preferred embodiment of the invention. The ducts-collecting case 131 further comprises: a case 1310, having a recess 1318 and a through hole 1313 channeling to the recess 1318; a dust-collecting lid 1312; and a box 1311; wherein, a side of the case 1310 is arranged with a groove hole 1314 channeling to the recess 1318; the through hole 1313 is channeled to the intake hole 1301 of the centrifugal fan unit while an extractable filtering device is arranged between the through hole 1313 and intake hole 1301 of the centrifugal fan unit.

Figure 6C:
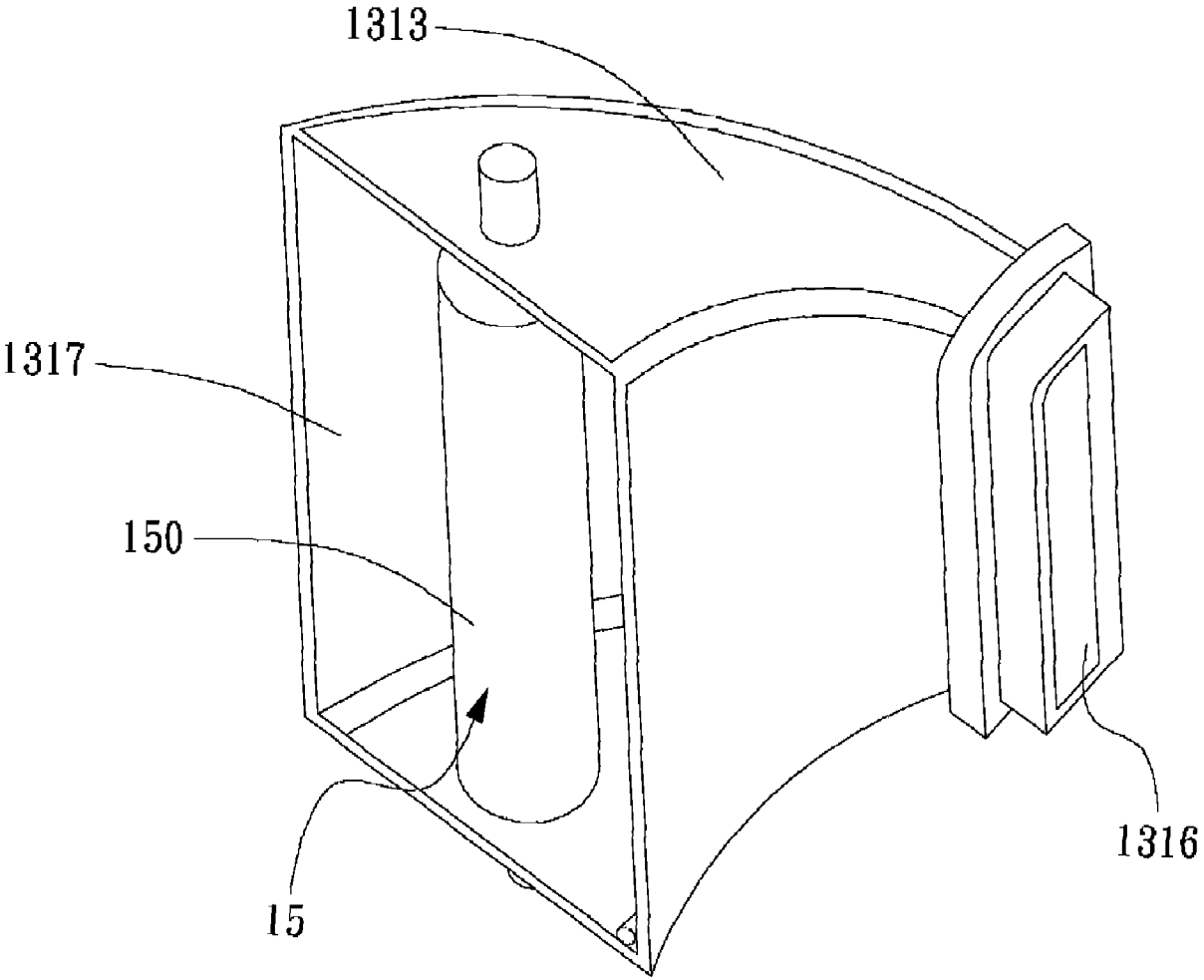
FIG. 6C is a pictorial view of a dust-collecting lid of the invention.
Figure 6D:
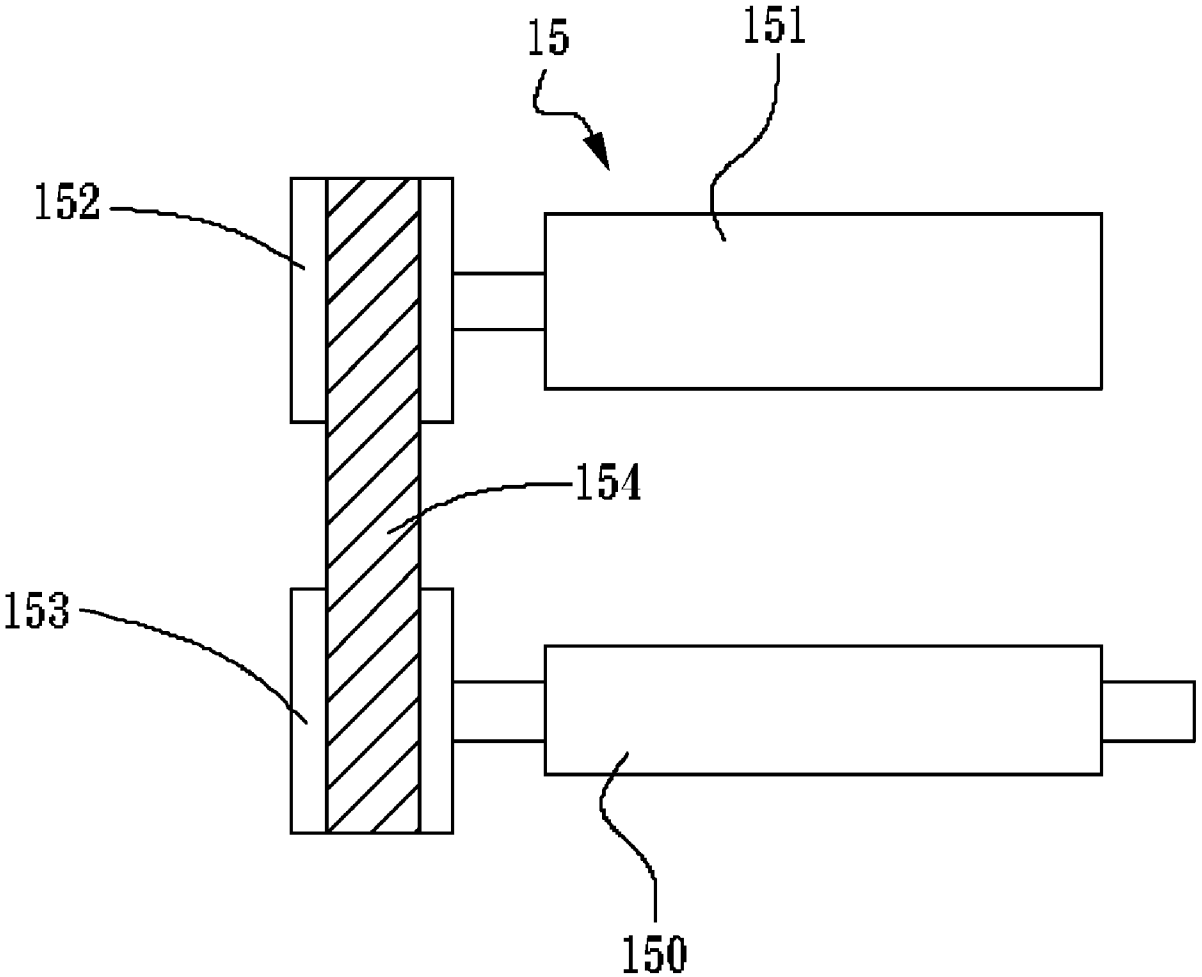
FIG. 6D is a schematic diagram showing a brushing roller device used in a robotic vacuum cleaner of the present invention, whereas the roller is being driven to rotate.

The box 1311 is formed with a dust-collecting space 1315, which is capable of being received in the recess 1308 as a drawer while enabling the duct-collecting space 1315 to channel with the through hole 1313 and the groove hole 1314. By which, a duct-collecting bag received in the duct-collecting space 1315 can be easily accessed and replaced as the box 1311 can be easily pulled out of the recess 1308. Please refer to FIG. 6C, which is a schematic diagram showing a dust-collect lid according to a preferred embodiment of the invention. As seen in FIG. 6C, an intake 1317 and an outflow 1316 are formed on the dust-collecting lid 1312 while the intake 1317 is channeled with the groove hole 1314 of the case 1310. In addition, a brushing roller device 15 can be arranged at the intake 1317 of the dust-collecting lid 1312. As seen in FIG. 6D, the brushing roller device 15 includes a brush 150 arranged at the intake of the dust-collecting lid 1312, and a speed reducer 151 capable of driving the brush 150 to rotate. The speed reducer 151, being composed of a motor and a gear box, is connected to a first gear 152 by an end thereof while the brush 150 is connected to a second gear 153 by an end thereof, whereas both the first and the second gears 152, 153 can be driven to rotate by a belt 154. It is noted that the parts used in the speed reducer are the same as those used in the driver of aforesaid driving wheel module. However, it can be an assembly of less torque.

In this preferred embodiment of the invention shown in FIG. 6A and FIG. 6B, for enabling air flow to flow smoothly in its airflow channel, the intake hole of its centrifugal fan unit is connected to the dust-collecting case through the dust-collecting lid 1312 while arranging the opening of the groove hole 1314 of the case 1310 at a side thereof instead of at the bottom thereof, by which the airflow channel is not twist for the consideration of improving dust-collecting efficiency and thus noise is reduced. Moreover, as the case 1310 and the box 1311 are structured as a drawer that the box 1311 can be pull out of the case 1310 easily, not only it is good for noise reduction, but also it is good for dust cleaning and filer replacing.

Figure 7:
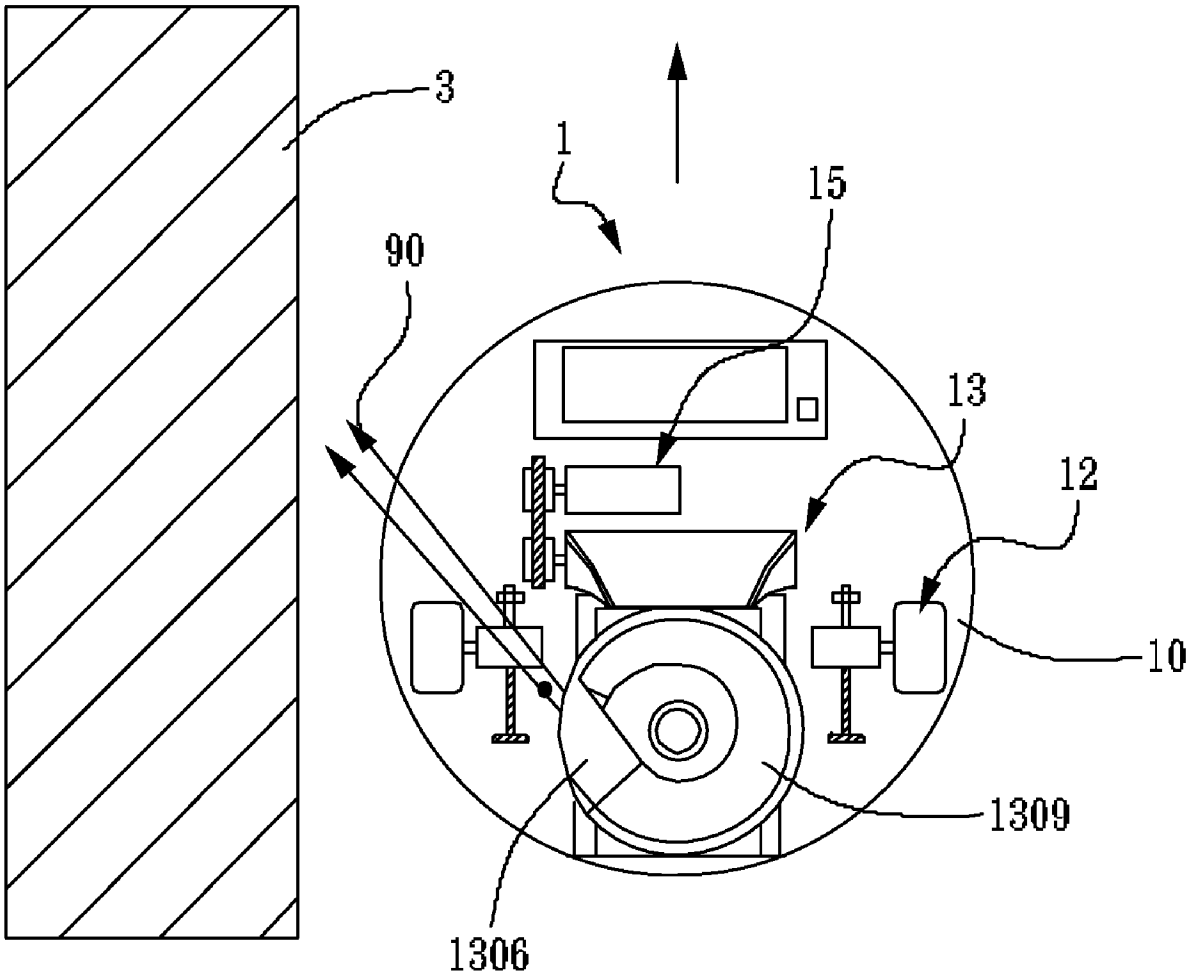
FIG. 7 is a schematic diagram illustrating the disposition of a dust-collecting case on a housing plate according to a preferred embodiment of the invention.

Please refer to FIG. 7, which is a schematic diagram illustrating the disposition of a dust-collecting case on a housing plate according to a preferred embodiment of the invention. In order to enforce the cleaning efficiency of the robotic vacuum cleaning of the invention, a helical airflow channel 1309 is formed extending from the outflow hole 1306 toward a side of case 1310, but not the bottom thereof, by which air blowing out of the centrifugal fan unit can be directed to those conventionally considered as dead spots. In FIG. 7, as air flow 90 is directed to blow toward a corner formed between a wall 3 and the robotic vacuum cleaner 1, dust accumulated at the corner is being blown away and thus can be vacuumed by the robotic vacuum cleaner 1.

Figure 8:
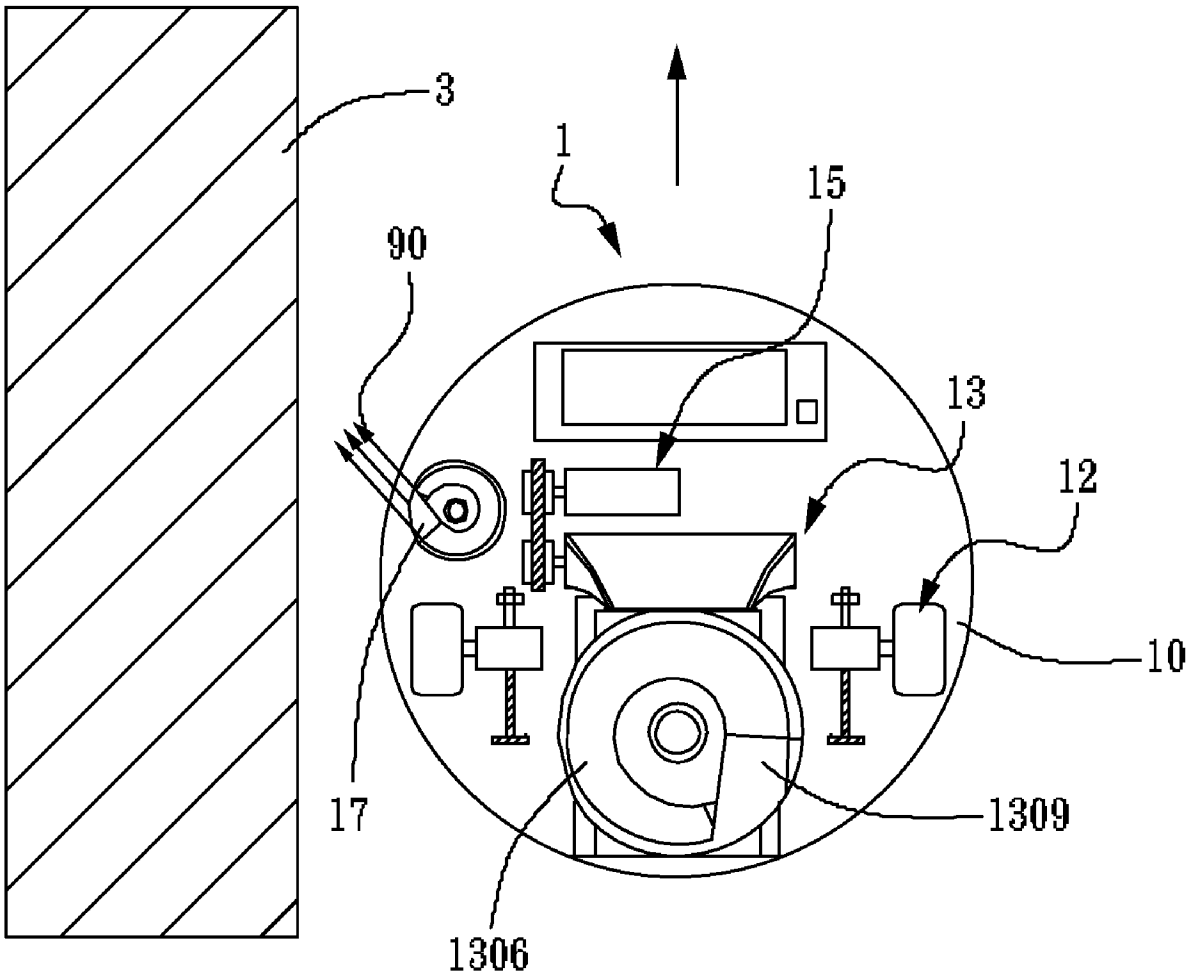
FIG. 8 is a schematic diagram illustrating the disposition of a dust-collecting case on a housing plate according to another preferred embodiment of the invention.

Please refer to FIG. 8, which is a schematic diagram illustrating the disposition of a dust-collecting case on a housing plate according to another preferred embodiment of the invention. Different from the disposition shown in FIG. 7, the robotic vacuum cleaner further comprises a side-wind generation unit 17, which is arranged on the housing plate 10 and used for providing a sideway air flow. In FIG. 8, as air flow 90 generating from the side-wind generation unit 17 is blowing toward a corner formed between a wall 3 and the robotic vacuum cleaner 1, dust accumulated at the corner is being blown away and thus can be vacuumed by the robotic vacuum cleaner 1. In a preferred aspect, the side-wind generation unit 17 can be a centrifugal fan device or an axial fan device, but is not limited thereby. That, is, it can be any device capable of generating side wind for blowing dust accumulated at dead spots.

As seen in FIG. 1, the collision prevention mechanism of the invention is designed to be disposed at edges of the robotic vacuum cleaner of the invention. One such collision prevention mechanism can be the collision sensor 14, as shown in FIG. 9A. In FIG. 9A, the collision sensor is comprised of: a base 142, a pillar 143, a first contact plate 144, a second contact plate 145 and a contacting part 147. The base 142 is fixed to a fixing end 140 while the fixing end 140 is fixedly arranged on the housing plate 10. The pillar 143 is slidably ensheathed by the base 142 while an end thereof is connected to the first contact plate 144. It is noted that a resilience element 141 is sandwiched between the first contact plate 144 and the fixing end 140 while the second contact plate 145 is arranged on the housing plate 10 at a position corresponding to the first contact plate 144. Moreover, both the first and the second contact plates 144, 145 are electrically connected to the controller 11. Furthermore, a post 146, boring through the housing plate 10, is arranged to connected to a surface of the first contact plate 144 by an end thereof while another end of the post 146 is connected to the contacting part 147. Thus, by the aforesaid collision sensor, the robotic vacuum sensor 1 is enabled to sense obstacles that are blocking its moving path.

Figure 9B:
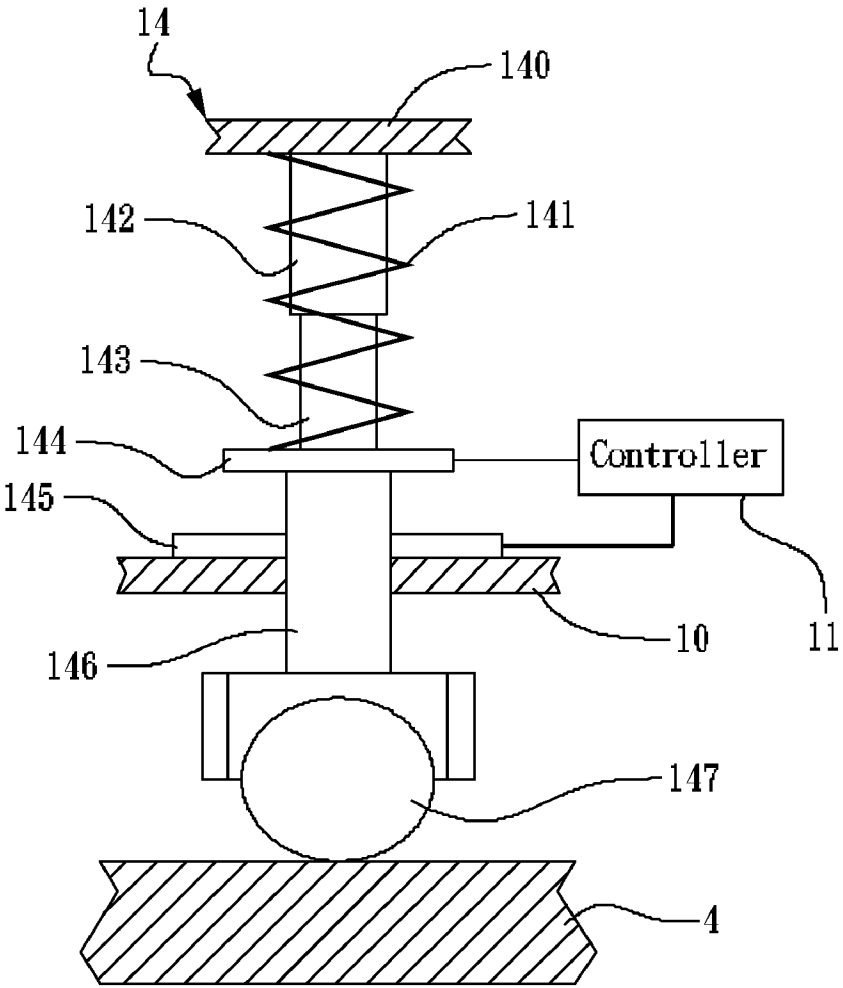
FIG. 9B is a top view of FIG. 9A.
Figure 9A:
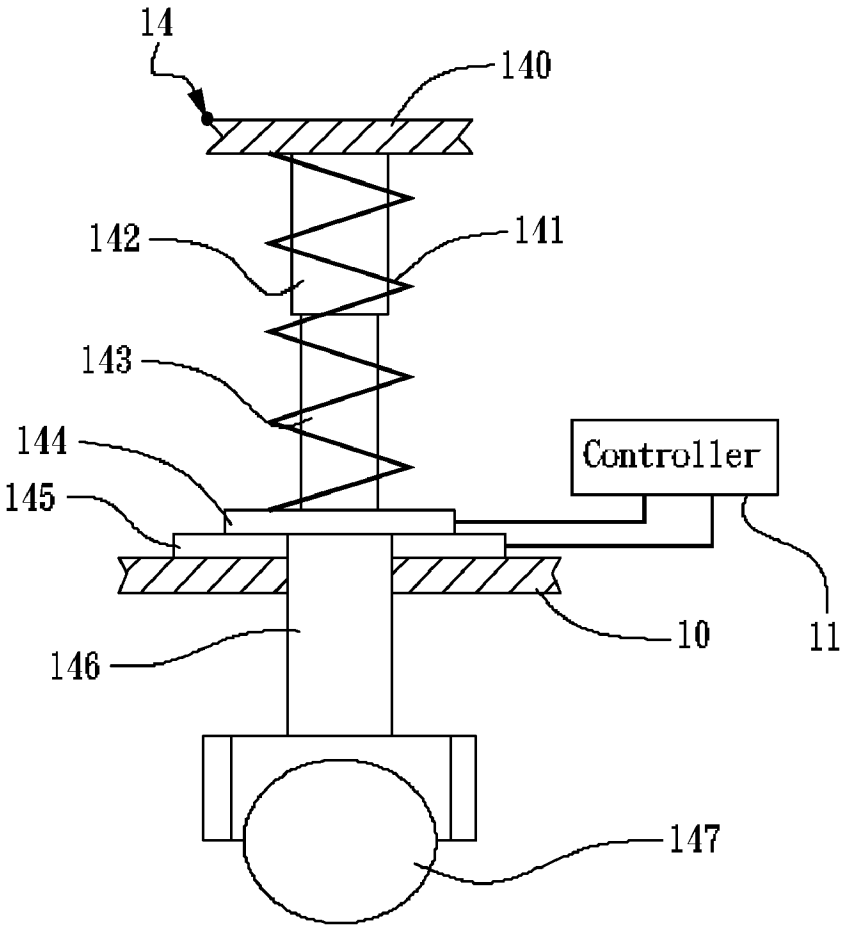
FIG. 9A shows a collision sensor used in a robotic vacuum cleaner of the present invention.

When the robotic vacuum sensor 1 encounters no obstacle, the resilience force of the resilience element 141 will force the first contact plate 144 to contact with the second contact plate 145 as shown in FIG. 9B. However, as the robotic vacuum sensor 1 encounters an obstacle 4 located at a side of the robotic vacuum sensor 1, the collision of the robotic vacuum sensor 1 and the obstacle 4 will cause the collision sensor 14 to contact with the obstacle 4, and thus push the contacting part 147 to withdraw and separate the first contact plate 144 from the second contact plate 145 while compressing the resilience element 141. As the first contact plate 144 is separated from the second contact plate 145, the controller 11, sensing the change of electrically properties, is notified of the existence of the obstacle 4, that the controller 11 will issue a command to control the driving wheel module for maneuvering around the obstacle 4. It is noted that the amount and disposition position of the collision sensor are dependent on actual requirement.

In a preferred embodiment of the invention, a plurality of obstacle detection units 16 can arranged at the bottom of the housing plate for evaluating the ground flatness or determining whether there is a drop on the ground. Please refer to FIG. 10A, which is a side view of an obstacle detection unit used in a robotic vacuum cleaner of the present invention. The obstacle detection unit 16 is composed of a base 162, a pillar 163, a first contact plate 164, a second contact plate 165 and a contacting part 167. The base 162 is fixed to a fixing end 160 while the fixing end 160 is fixedly arranged on the housing plate 10. The pillar 163 is slidably ensheathed by the base 162 while an end thereof is connected to the first contact plate 164. It is noted that a resilience element 161 is sandwiched between the first contact plate 164 and the fixing end 160 while the second contact plate 165 is arranged on the housing plate 10 at a position corresponding to the first contact plate 164. Moreover, both the first and the second contact plates 164, 165 are electrically connected to the controller 11. Furthermore, a post 166, boring through the housing plate 10, is arranged to connected to a surface of the first contact plate 164 by an end thereof while another end of the post 166 is connected to the contacting part 167, whereas the contacting part 167 is positioned to face toward for readying to contact the ground. Thus, as the contacting part 167 is in contact with the ground, it is driving to roll with the movement of the robotic vacuum sensor 1.

Figure 10B:
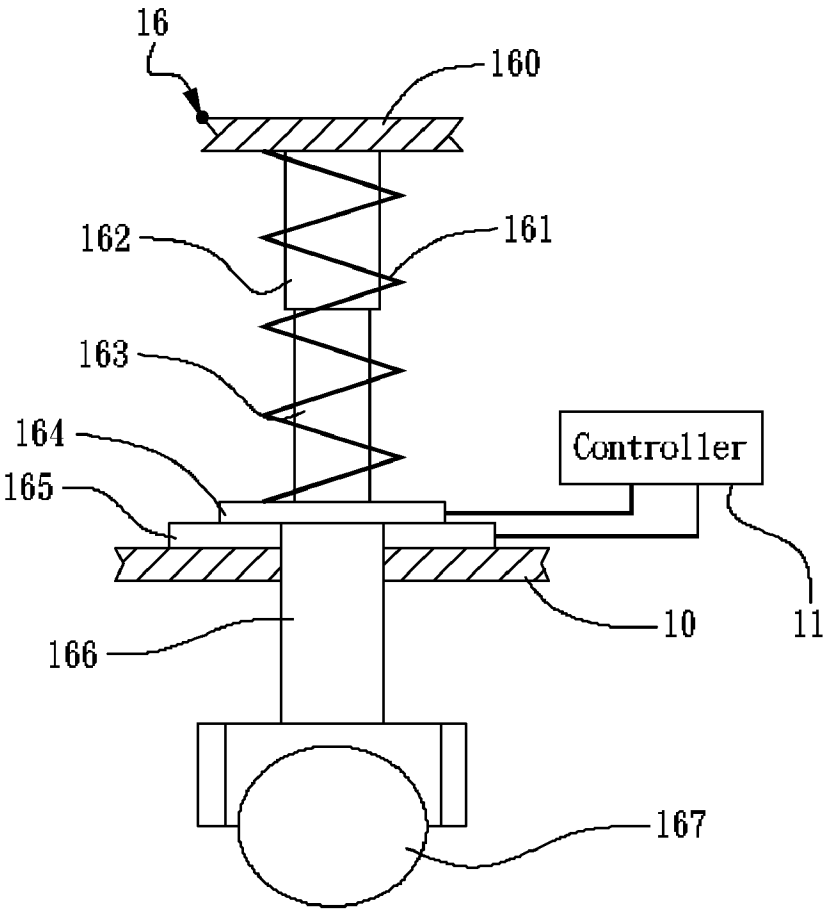
FIG. 10B is a schematic diagram showing an obstacle detection unit as it is being activated.
Figure 10A:
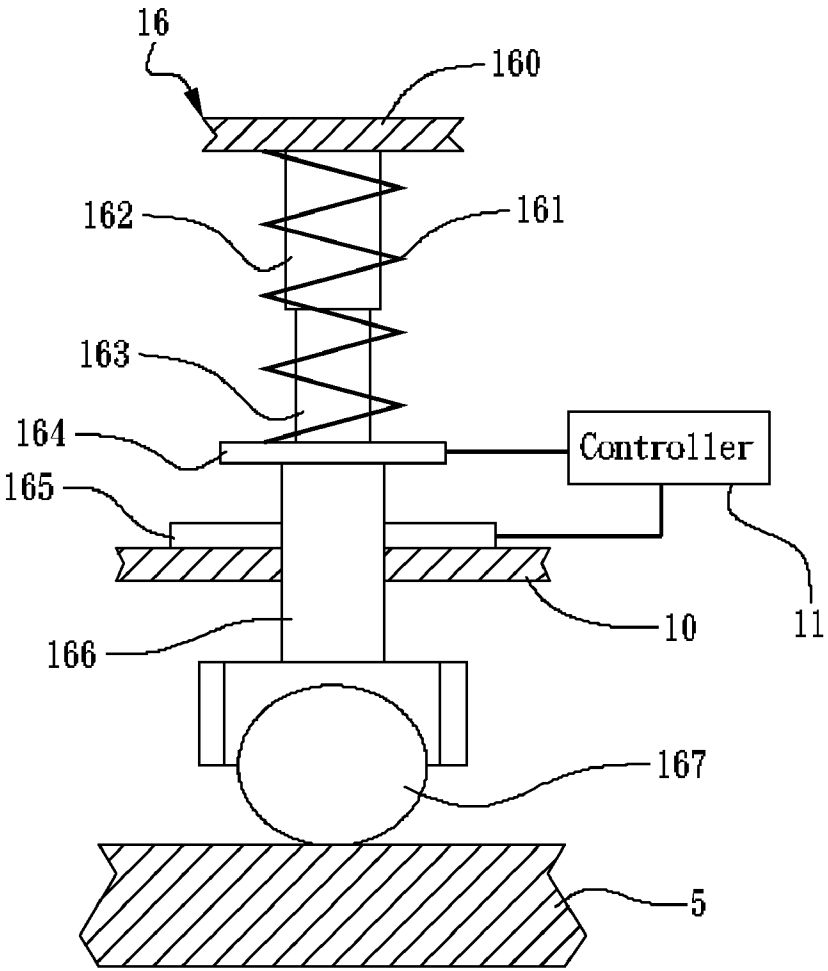
FIG. 10A is a side view of an obstacle detection unit used in a robotic vacuum cleaner of the present invention.

As seen in FIG. 10A, the obstacle detection unit 16 is in contact with the ground when operating normally that will compress the resilience element 161 and thus further cause the first contact plate 164 to separate from the second contact plate 165. Please refer to FIG. 10B, which is a schematic diagram showing an obstacle detection unit as it is being activated. When there is a fall on the moving path of the robotic vacuum cleaner 1, the obstacle detection unit 16 is relived from the pressing force of the ground that release the compression of the resilience element 161 and thus the resilience force the resilience element 161 will push the first contact plate 164 to contact the second contact plate 165. As the first contact plate 164 is in contact with the second contact plate 165, the controller 11, sensing the change of electrically properties, is notified of the fall, that the controller 11 will issue a command to control the driving wheel module for maneuvering around the obstacle 4. It is noted that the amount and disposition position of the collision sensor are dependent on actual requirement.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A robotic vacuum cleaner, comprising:
a controller, disposed on a housing plate;
at least a driving wheel module, each being disposed on the housing plate while electrically connecting to the controller, each further comprising:
a driver;
a wheel, connecting to an output shaft of the driver;
a linkage rod, having two ends pivotally fixed on the housing plate and the driver respectively; and
a resilience element, having two ends pivotally connected to the housing plate and the driver respectively; and
a dust-collecting module, disposed on the housing plate for vacuuming for filtering and collecting dust, comprising:
a dust-collecting case, having a vacuum inlet positioned under the housing plate; and
a centrifugal fan unit, connected to the dust-collecting case by an intake end thereof for receiving air flow sucked from the vacuum inlet.

2. The robotic vacuum cleaner of claim 1, wherein the centrifugal fan unit further comprises:
a housing with an accommodating space, having an intake hole and an outflow hole;
an impeller, arranging in the accommodating space while enabling an airflow channel of uniform width to be formed between a rim of the impeller and a side wall of the housing, and enabling the accommodating space to be divided into a first space and a second space by a virtual cross section passing the axial center of the impeller for enabling the first space to be asymmetrical to the second space; and
a driving device, connected to the impeller for driving the same to rotate.

3. The robotic vacuum cleaner of claim 2, wherein a helical airflow channel is extending from the second space and channeling to the outflow hole.

4. The robotic vacuum cleaner of claim 3, wherein the sectional area of the helical airflow channel is increasing progressively from the beginning thereof to the outflow hole.

5. The robotic vacuum cleaner of claim 2, wherein each blade used in the impeller is a blade selected from the group consisting of airfoil blades of signal-blade design and airfoil blades of dual-blade design.

6. The robotic vacuum cleaner of claim 2, wherein the air flow discharged from the outflow hole is directed toward a side of the housing plate for facilitating the cleaning of dust accumulated at corners.

7. The robotic vacuum cleaner of claim 1, wherein the dust-collecting case further comprises:
a case, having a recess and a through hole channeling to the recess, and a side thereof being arranged with a groove hole channeling to the recess;
a dust-collecting lid, having the vacuum inlet arranged thereon while being connected to the groove hole; and
a box with a dust-collecting space, capable of being received in the recess for enabling the duct-collecting space to channel with the through hole and the groove hole.

8. The robotic vacuum cleaner of claim 1, wherein a filtering device is arranged between the centrifugal fan unit and the dust-collecting case.

9. The robotic vacuum cleaner of claim 1, wherein an edge of the housing plate is designed with a rake angle.

10. The robotic vacuum cleaner of claim 1, wherein a collision sensor, electrically connected to the controller, is arranged at a front end of the housing plate.

11. The robotic vacuum cleaner of claim 10, wherein the collision sensor detects pressure applied to the sensor.

12. The robotic vacuum cleaner of claim 10, wherein the collision sensor is comprised of:

a base;

a resilience element, ensheathing the base;

a pillar, having an end abutted against the resilience element;

a first contact plate, connected to an end of the pillar not abutted against the resilience element; and a second contact plate, being arranged at a position corresponding to the first contact plate.

13. The robotic vacuum cleaner of claim 10, wherein at least an obstacle detection unit is arranged at the bottom of the housing plate while enabling each to be electrically connected to the controller.

14. The robotic vacuum cleaner of claim 13, wherein each obstacle detection unit is comprised of:

a base; a resilience element, ensheathing the base;

a pillar, having an end abutted against the resilience element;

a first contact plate, connected to an end of the pillar not abutted against the resilience element; and a second contact plate, being arranged at a position corresponding to the first contact plate.

15. The robotic vacuum cleaner of claim 1, wherein an interfacing part is arranged between the wheel and the driver for enabling the wheel to be detachable.

16. The robotic vacuum cleaner of claim 1, further comprising a brushing roller device.

17. The robotic vacuum cleaner of claim 16, wherein the brushing roller device is further connected to a brushing driver, the brushing driver comprising:

a first gear, connected to an end of the brushing roller device;

a second gear;

a speed reducer, having an end connected to the second gear; and a belt, being installed by warping and mounting the same on the first and the second gears.

18. The robotic vacuum cleaner of claim 1, wherein a side-wind generation unit is arranged at a side of the housing plate.

19. The robotic vacuum cleaner of claim 18, wherein the side-wind generation unit is a device selected from the group consisting of a centrifugal fan unit and an axial fan unit.

* * * * *